US012114810B1

(12) United States Patent
De La Cruz

(10) Patent No.: US 12,114,810 B1
(45) Date of Patent: Oct. 15, 2024

(54) PORTABLE SINK WASHING STATION

(71) Applicant: Jannet De La Cruz, San Jose, CA (US)

(72) Inventor: Jannet De La Cruz, San Jose, CA (US)

( * ) Notice: Subject to any disclaimer, the term of this patent is extended or adjusted under 35 U.S.C. 154(b) by 108 days.

(21) Appl. No.: 17/972,724

(22) Filed: Oct. 25, 2022

(51) Int. Cl.
*A47K 1/02* (2006.01)
*A47K 5/06* (2006.01)
*A47K 10/18* (2006.01)

(52) U.S. Cl.
CPC ..... *A47K 1/02* (2013.01); *A47K 5/06* (2013.01); *A47K 10/18* (2013.01)

(58) Field of Classification Search
CPC ..... A47K 1/02; A47K 5/06; A47K 10/18
USPC ..... 4/625, 619, 626, 627
See application file for complete search history.

(56) References Cited

U.S. PATENT DOCUMENTS 4,747,169 A * 5/1988 Valbuena ..... E03C 1/18 4/642
5,313,676 A * 5/1994 Wright ..... A47K 1/02 4/631
5,465,438 A * 11/1995 Allman ..... A47K 1/02 4/640
5,502,848 A * 4/1996 Cowan ..... A47K 1/02 4/654
5,687,434 A * 11/1997 Tagg ..... E03B 11/04 4/628
5,702,115 A * 12/1997 Pool ..... A61G 12/001 280/47.35
5,704,078 A * 1/1998 Chandler ..... A47K 11/02 4/449
5,881,404 A * 3/1999 Knight ..... A47K 1/02 4/619
6,101,643 A * 8/2000 Moore ..... A47K 1/02 4/631
6,173,458 B1 * 1/2001 Maddux ..... A47K 1/02 4/619
6,298,502 B1 * 10/2001 Brown ..... E03C 1/16 4/619

(Continued)

FOREIGN PATENT DOCUMENTS

BR 202013015027 U2 * 9/2015 ..... A47K 1/02
CA 2823609 A1 * 2/2014 ..... A47K 1/02

(Continued)

*Primary Examiner* — Lori L Baker
(74) *Attorney, Agent, or Firm* — Sanchelima & Associates, P.A.; Christian Sanchelima; Jesus Sanchelima

(57) ABSTRACT

A portable sink washing station including a sink assembly with a reservoir assembly mounted thereon and a container assembly connected thereof. The sink assembly includes a sink with an elongated L-shaped body that includes a napkin dispenser and a soap dispenser. The reservoir assembly includes a reservoir which conforms with a top surface of the sink and is configured to allow water to flow into the sink by a faucet attached thereof. The container assembly includes a container that is connected to a bottom portion of the sink by a hose adapter to permit the flow of water and store drained water therein. The reservoir includes a mirror and a trash can to cooperate with the use of the sink when washing the user's hands. The sink with the reservoir and the container are configured to be portable to different environments by handles and an attaching portion.

1 Claim, 4 Drawing Sheets

(56) References Cited

U.S. PATENT DOCUMENTS 6,401,274 B1 * 6/2002 Brown ..... A47K 1/02 4/619
7,441,286 B1 * 10/2008 Taylor Parker ..... A47K 1/02 280/652
7,802,327 B1 * 9/2010 Moceri ..... A47K 1/02 4/619
8,082,611 B1 * 12/2011 Marshall ..... A47K 1/02 239/146
8,528,126 B2 * 9/2013 Al-Mahnna ..... A47K 1/02 4/626
8,973,179 B2 * 3/2015 Thwaites ..... A47K 1/02 4/647
9,161,621 B1 * 10/2015 Huffin ..... A47K 10/18
9,585,522 B1 * 3/2017 Brown, Sr. ..... B60R 9/02
10,271,691 B1 * 4/2019 Boyle ..... A47K 1/02
10,337,662 B1 * 7/2019 Gradillas ..... B67D 3/0029
11,197,585 B1 * 12/2021 Podemska-Mikluch ..... A47K 1/04
11,219,337 B1 * 1/2022 Austin ..... A47K 1/02
11,641,982 B2 * 5/2023 Hayden ..... A47K 1/02 4/625
11,896,171 B2 * 2/2024 Gallob ..... A47K 10/48
11,939,755 B1 * 3/2024 Post ..... E03C 1/186
2002/0184704 A1 * 12/2002 Cawthon ..... A22C 25/06 4/619
2004/0148697 A1 * 8/2004 Patterson ..... A47K 1/02 4/619
2006/0137379 A1 * 6/2006 Cawthon ..... E03C 1/18 62/457.7
2007/0192953 A1 * 8/2007 Hughes ..... A47K 1/02 4/625
2007/0199146 A1 * 8/2007 Kostelyk ..... E03B 11/02 4/625
2007/0256236 A1 * 11/2007 Switzer ..... A47F 9/00 4/631
2008/0098513 A1 * 5/2008 Hardway ..... A47K 10/42 4/625
2009/0113618 A1 * 5/2009 Slayton ..... A47K 1/02 4/653
2009/0301523 A1 * 12/2009 Barnhill ..... G16H 40/20 4/625
2012/0102638 A1 * 5/2012 Al-Mahnna ..... A47K 1/02 4/626
2013/0212801 A1 * 8/2013 Slayton ..... A47K 1/02 4/643
2014/0047636 A1 * 2/2014 Thwaites ..... A47K 1/02 4/647
2014/0259378 A1 * 9/2014 Combs ..... A47K 1/02 4/643
2014/0366262 A1 * 12/2014 Flynn ..... A47K 3/32 4/514
2016/0045077 A1 * 2/2016 Wade ..... G05D 9/02 137/151
2016/0192813 A1 * 7/2016 Wade ..... A47L 13/10 4/626
2018/0140142 A1 * 5/2018 Aich ..... A47K 1/02
2018/0153350 A1 * 6/2018 Harding ..... A47K 1/02
2021/0161333 A1 * 6/2021 Clawson ..... A47K 1/04
2021/0401234 A1 * 12/2021 Chance ..... B65D 81/36
2022/0025625 A1 * 1/2022 Roncadori ..... E03B 1/041
2022/0361717 A1 * 11/2022 Braxton ..... A47K 5/1202
2023/0003009 A1 * 1/2023 Peavy ..... A47K 1/02
2023/0371755 A1 * 11/2023 Nguyen ..... E03C 1/326

FOREIGN PATENT DOCUMENTS

CA 3145925 A1 * 7/2022 ..... A47K 1/02
DE 102020121994 B3 * 1/2022
WO WO-9920848 A2 * 4/1999 ..... A47K 1/02
WO WO-0134010 A1 * 5/2001 ..... A22C 25/025
WO WO-2004012500 A2 * 2/2004 ..... A22C 25/025
WO WO-2018231385 A1 * 12/2018
WO WO-2020224892 A1 * 11/2020 ..... A45D 19/04
WO WO-2021211166 A1 * 10/2021 ..... A47K 1/02
WO WO-2021262908 A1 * 12/2021 ..... A47K 1/02
WO WO-2022232872 A1 * 11/2022 ..... A45D 19/04
WO WO-2022248590 A1 * 12/2022
WO WO-2024020066 A2 * 1/2024 ..... A47K 1/02

* cited by examiner

PORTABLE SINK WASHING STATION

BACKGROUND OF THE INVENTION

1. Field of the Invention

The present invention relates to a portable sink washing station and, more particularly, to a portable sink washing station that includes a sink with a top reservoir fluidly connected to a faucet that drains the water to a container by a hose connected to the sink which also includes dispensers of soap, napkins, a receptacle trash and a mirror to allow the user to wash his hands.

2. Description of the Related Art

Several designs for portable sinks have been designed in the past. None of them, however, include a portable sink washing station that includes a reservoir to dump water and fluid into a faucet to wash user's hands and drain the water in a container which is connected to the sink by a hose.

Applicant believes that a related reference corresponds to U.S. Pat. No. 11,197,585 issued for a portable child's sink with a reservoir and a collection vessel. Applicant believes that another related reference corresponds to U.S. Pat. No. 8,973,179 issued for a portable camping sink with a water container with a spout which sits over a basin. None of these references, however, teach of a portable sink washing station that is comprised of a sink assembly with an integrated fresh water reservoir which is fluidly connected to a faucet member which allows the water reservoir to flow into the sink basin where it is drained into a gray water container; the sink assembly also contains a mirror, napkin dispenser, soap dispenser, and a trash receptacle.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a portable sink washing station that allows the user to wash their hands in multiple environments.

It is another object of this invention to provide a portable sink washing station with a faucet connected to a portable container to drain the water.

It is still another object of the present invention to provide a portable sink washing station that integrates a freshwater reservoir with a cap to refill several times.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
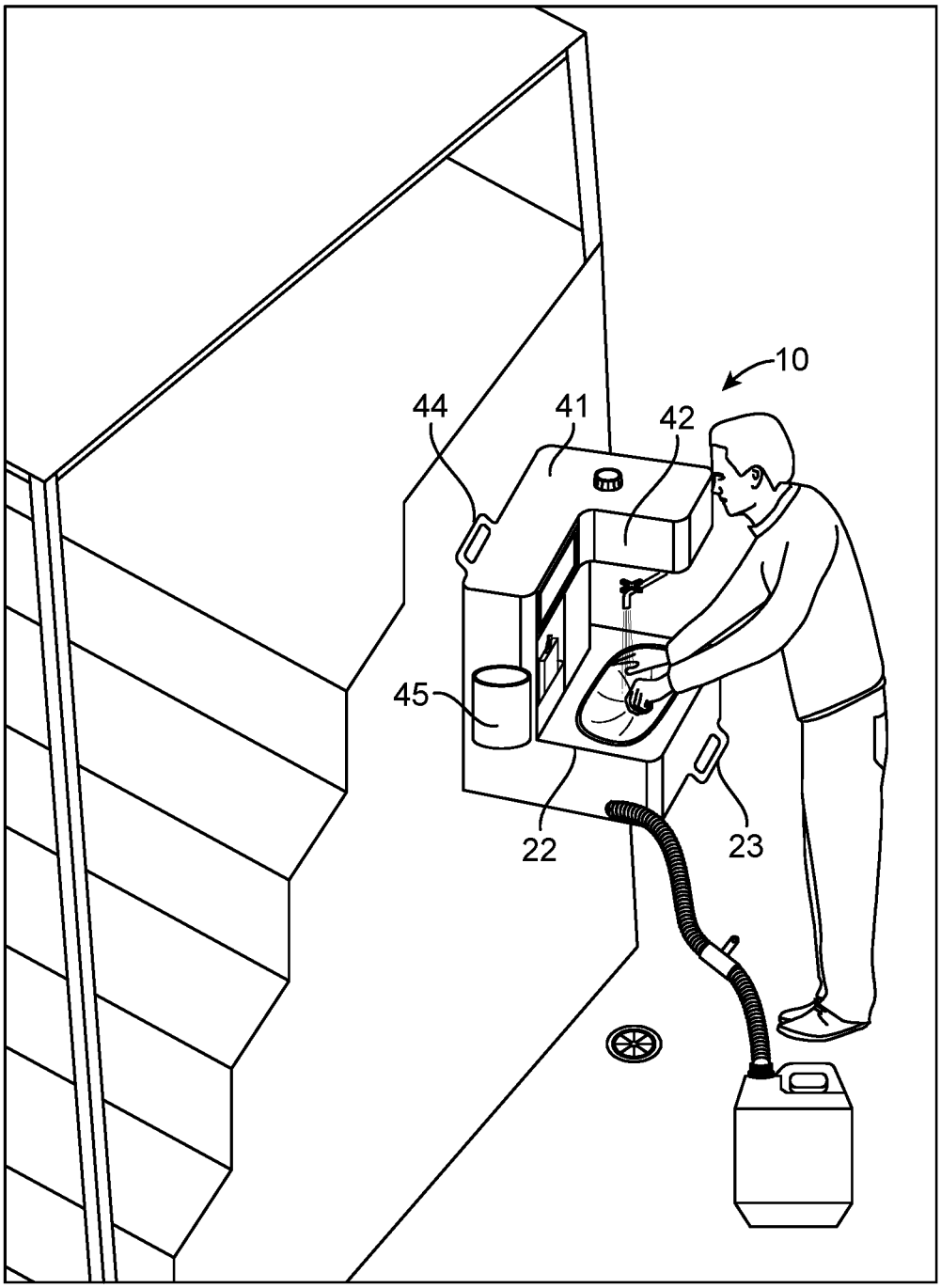
FIG. 1 represents an operational view of the present invention 10.

Referring now to the drawings, where the present invention is generally referred to with numeral 10, it can be observed that it basically includes a sink assembly 20, a reservoir assembly 40 and a container assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 4:
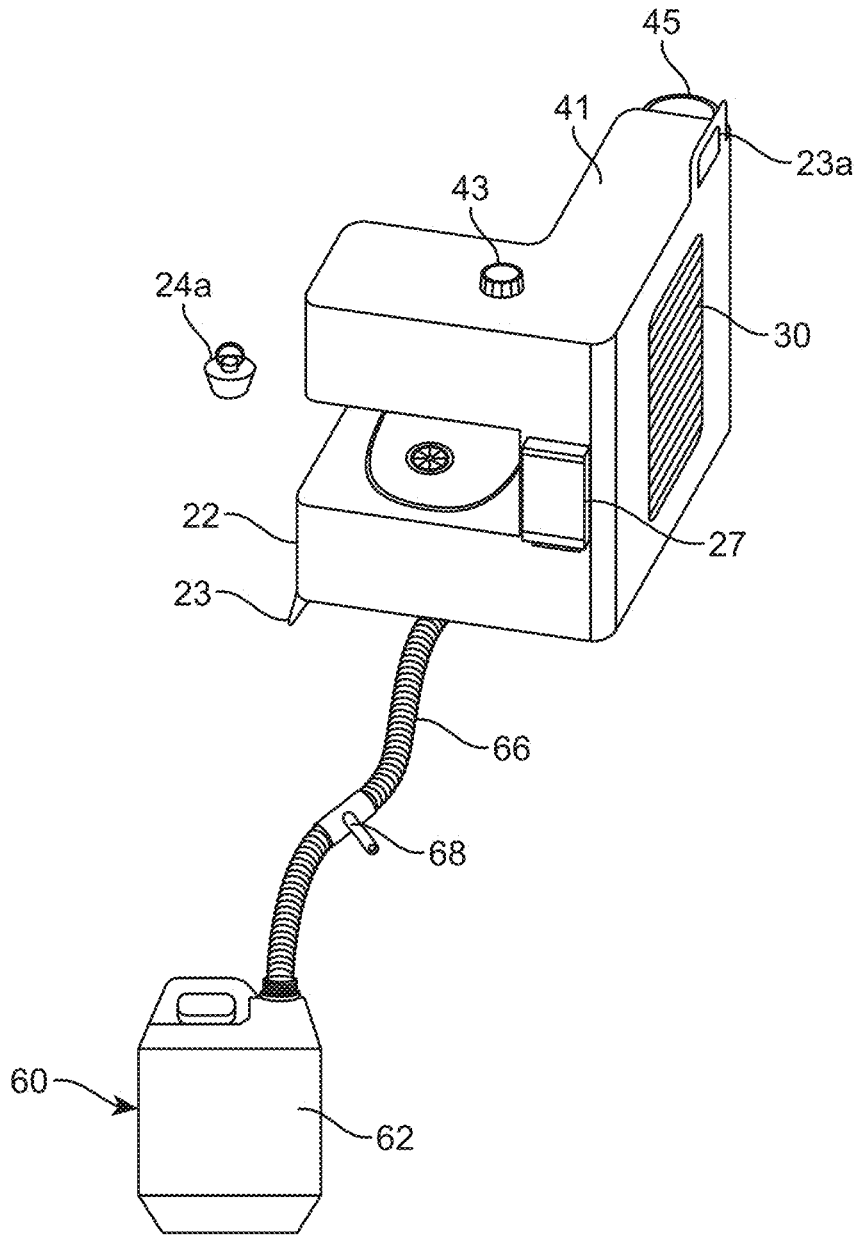
FIG. 4 represents a rear isometric view of the sink 22. An attaching portion 30 is shown in a rear portion of the sink 22 and the reservoir 41.

The sink assembly 20 includes a sink 22, a bottom handle 23, a strainer 24, a bath plug 24*a*, a hose adapter 26, a napkin dispenser 27, a soap dispenser 28 and an attaching portion 30. The sink 22 in the known art may have a sink body with an elongated body in a rear portion as best observed in FIG. 1 wherein the sink 22 comprises an L-shape body. In a suitable embodiment, the sink 22 may have an inner portion which may be angled to allow it to use it as a reservoir when sealing thereof by the bath plug 24*a*. It may be considered that the present invention 10 may be configured to be used in a camping or sport environment. Nonetheless, in other embodiments, the present invention 10 may be used in any other environment by filling the reservoir assembly 40 with water. In a preferred embodiment, the sink 22 may be made of a plastic material to provide a light sink. Nevertheless, another material like aluminum may be suitable for the sink 22. For those experts in the art it may be understood that sink may include the strainer 24, the second cap 26*a* and the bath plug 24*a* may be items required by the sink 22 to function wherein the second cap 26*a* may be configured to seal the sink 22 by the hose adapter 26 allowing to use the sink 22 without the container assembly 60 and the strainer 24 and the bath plug 24*a* may be integrated on the sink 22 allowing to store the water within the sink 22. The strainer 24 and a bath plug 24*a* may be made of aluminum material. The sink 22 may include a bottom handle 24 and further a top handle 44 wherein the bottom handle 23 may be attached to a bottom rear portion of the sink 22 as shown in FIG. 4 and the top handle 44 may be placed in a top portion of the sink 22 allowing to transport and attach the sink 22 to any wall or object.

Figure 2:
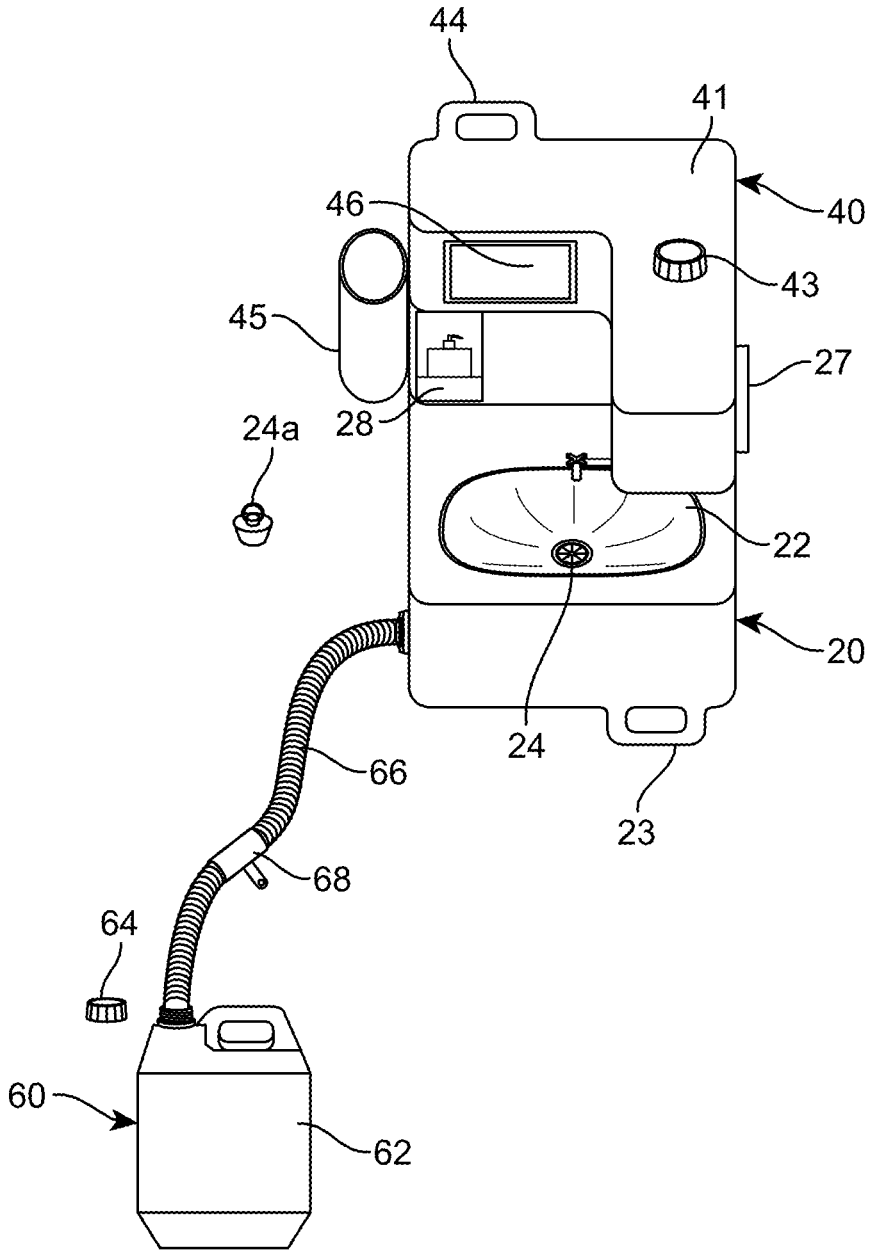
FIG. 2 shows a perspective top view of the reservoir assembly 40, the sink assembly 20 and the container assembly 60.
Figure 3:
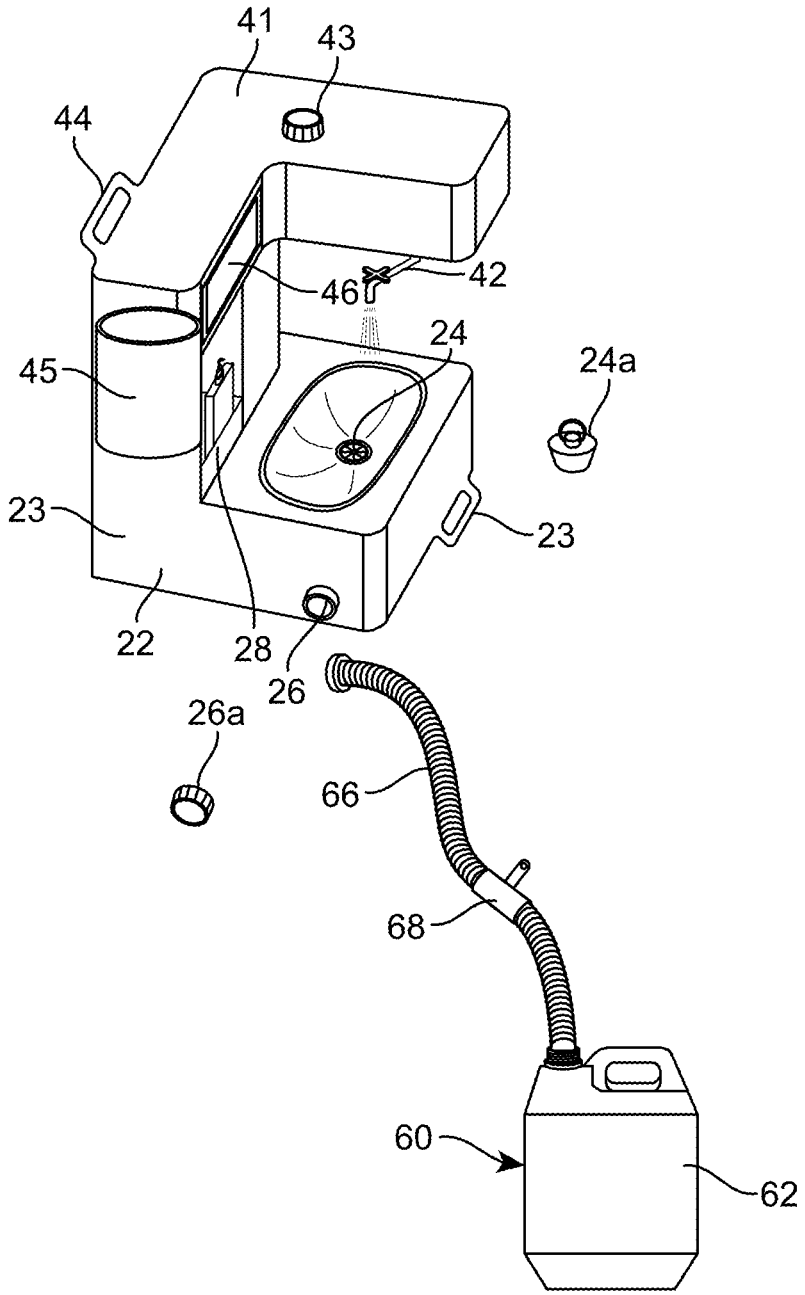
FIG. 3 illustrates an isometric view of the sink assembly 20 also showing the container 62.

It may be understood that the sink 22 may operate when filling the reservoir assembly 40 with water. The hose adapter 26 may be configured to seal the strainer 24 as known in the art. In one embodiment the napkin dispenser 27 may be attached to a lateral side of the sink 22 as shown in FIG. 4. Nevertheless, in another embodiment, the napkin dispenser 27 may be attached to a front portion of the sink 22. The soap dispenser 28 in a preferred embodiment may be attached to a front portion of the sink 22 as illustrated in FIG. 2 below the mirror 46, it may be considered that the soap dispenser 28 may be a bottle or any other container of soap placed within a receptacle disposed on a top front portion of the sink 22. The soap dispenser 28 may have a cylindrical body, a rectangular body, an oval body, a regular body, an irregular body or any other suitable shape for a container of soap. Soap dispenser 28 may be disposed to a lateral receptacle of the sink 22, wherein the receptacle may have a suitable volume to receive the soap dispenser 28. Best depicted in FIG. 2. As known in the art the soap dispenser 28 and the napkin dispenser 27 may be configured to dispense soap and napkins respectively. Nevertheless, the soap dispenser 28 and the napkin dispenser 27 attached to the sink 22 may be configured to dispense soap and napkins while using sink 22 which may be transportable to any environment. The attaching portion 30 may be partially placed over a rear surface of the sink 22 as illustrated in FIG. 4 wherein the attaching portion 30 may be made of a rigid plastic to withstand sink 22 when attached to a surface by a rear portion. In a preferred embodiment, the attaching portion 30 may be configured to be adaptive to any surface by including a type of fasteners like straps, belts, bolts, screws, or any other variation thereof suitable for an attachment. It may be considered that the bottom handle 23 and the top handle 44 may cooperate with the attaching portion 30 allowing to attach the sink 22 to any surface wherein the bottom handle 23 is attached to a front bottom portion of the sink 22 as best observed in FIG. 2 while the top handle 44 is attached to a top rear portion of the reservoir 41 as best observed in FIG. 3. As best observed in FIG. 3 the hose adapter 26 may be attached to a bottom side portion of the sink 22 and connected to sink 22 allowing to discharge water thereof and store the water to the container assembly 60. In another embodiment, the sink 22 may be sealed by the second cap 26*a* avoiding using the container assembly 60.

The reservoir assembly 40 includes a reservoir 41, a faucet 42, a cap 43, the top handle 44, a trash can 45 and a mirror 46. As known in the art the reservoir 41 may be suitable to store liquid wherein the reservoir 41 may be mounted to a top portion of the sink 22 as best observed in FIG. 2 to allow fill thereof with water to dispense when opening the faucet 42 which may be attached to a bottom portion of the reservoir 41, wherein the flow water may be perpendicular to the sink 24 by means of a predetermined pipe configuration between the faucet 42 and the reservoir 41. Nevertheless, it should be considered that other sides of reservoir 41 may be suitable for the faucet 42 to be attached. The reservoir 41 may have a shape that conforms with a top surface of the sink 22 having an L-shaped body wherein the reservoir 41 is attached to a top portion of the sink 22 partially remaining above the sink 22. It may be suitable for reservoir 22 to be made of a plastic material. The reservoir 41 may be configured to dispense water when activating the faucet 42 allowing the user to wash his hands and configured to channel the water through a bottom of the sink 22 and the hose adapter 26. In a preferred embodiment the reservoir 41 may have a cap 43 on a top surface thereof configured to add water to the reservoir 41 when removing the cap 43 and seals the reservoir 41.

As best shown in FIG. 2 the reservoir 41 may include a mirror 46 attached to a front side above the soap dispenser 28. The mirror 46 as known in the art is generally used with a bathroom sink. The mirror 46 attached to the reservoir cooperates with the sink 22, the soap dispenser 28, the napkin dispenser 27 after washing the user's hands. The reservoir 41 in another embodiment may have the trash can 45 attached to a lateral side thereof. As known in the art the trash can 45 is used for the disposal of waste matter. The trash can 45 is configured for the disposal of napkins of the napkin dispenser 27 after washing the user's hands. In a preferred embodiment, the trash 45 may be a trash receptacle. In a suitable embodiment the reservoir 41 may include the top handle 44 in a rear side as best observed in FIG. 4 wherein the top handle 44 may have a rectangular shape which the bottom handle 23 may have.

The container assembly 60 includes a container 62, a container cap 64, a hose 66, and a faucet adapter 68. The container 62 may be configured to receive the water drained by the sink 22 after washing the user's hands. The container 62 may be made of a plastic material and may be volumetrically suitable to store the water and withstand being transported. In a preferred embodiment the container 62 may include the hose 66 which is connected to the hose adapter 26 allowing to drain the water therethrough while washing the user's hands. In a suitable embodiment the hose 66 may be adapted to any type of container allowing to store a predetermined amount of liquid. It may be understood that the container 62 and the hose 66 may cooperate with the hose adapter 26 when using the sink 22 to wash the user's hands with water expelled from the reservoir 41 by opening the faucet 42. The faucet adapter 68 is attached to the hose 66 allowing it to drain water when the container 62 may reach a predetermined amount of liquid therein. The container 62 may include the container cap 64 allowing to seal the container 62 when removing the hose 66 from the container 62 allowing to drain the water from the sink 22 to any sewer or the ground when required.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A portable sink washing station, consisting of:

a sink assembly including a sink having an L-shaped body, said sink being portable by a bottom handle, top handle and an attaching portion which allows to attach said sink to any surface or object, said bottom handle, top handle and attaching portion being coplanar in a rear surface of said sink, said sink including a napkin dispenser in a lateral side thereof being exposed outwardly, said sink including a soap dispenser in a top front portion thereof, said sink having a hollow body that connects with a hose adapter which is attached in a bottom side portion thereof configured to drain water, said hose adapter is attached to a bottom side portion of said sink being coplanar with a trash can;

a reservoir assembly including a reservoir mounted to a top surface of said sink, said reservoir being coplanar by a rear surface thereof, said reservoir configured to be fluid connected with a faucet that allow the dispense of water, said reservoir including a mirror placed above said soap dispenser and a trash can attached to a lateral side thereof being coplanar with said hose adapter, said faucet attached on a bottom portion thereto, wherein a predetermined pipe configuration between said faucet and said reservoir allows the flow of water into said sink to further be drained, said trash can attached to a lateral side of said reservoir being exposed outwardly, said reservoir including mirror attached to a front side thereof above said soap dispenser, said attaching portion partially covering a rear portion of said sink and said reservoir; and a container assembly including a container related to said sink assembly by a hose, said container configured to receive a predetermined amount of water from said reservoir while using the sink that drains the water through said hose into said container, said hose including a faucet adapter to connect alternative drainers while using the sink to wash the user's hands, said hose being removable when draining predetermined amount of liquid from said reservoir while using said sink, said container being customized in a predetermined size.

* * * * *